US006626021B2

(12) United States Patent
Okuda et al.

(10) Patent No.: US 6,626,021 B2
(45) Date of Patent: Sep. 30, 2003

(54) ENGINE OIL PAN AND FORMING METHOD AND APPARATUS

(75) Inventors: Tsutomu Okuda, Ogaki (JP); Koji Tsuiki, Ogaki (JP); Manabu Hayano, Ogaki (JP)

(73) Assignee: Pacific Industrial Co., Ltd., Gifu-ken (JP)

( * ) Notice: Subject to any disclaimer, the term of this patent is extended or adjusted under 35 U.S.C. 154(b) by 203 days.

(21) Appl. No.: 09/896,407

(22) Filed: Jun. 27, 2001

(65) Prior Publication Data

US 2001/0037788 A1 Nov. 8, 2001

Related U.S. Application Data

(62) Division of application No. 09/393,901, filed on Sep. 10, 1999, now Pat. No. 6,273,049.

(30) Foreign Application Priority Data

Aug. 4, 1999 (JP) ..... 11-220757

(51) Int. Cl.[7] ..... B21D 22/26
(52) U.S. Cl. ..... 72/353.4; 72/357
(58) Field of Search ..... 72/353.2, 353.4, 72/353.6, 354.6, 357, 392

(56) References Cited

U.S. PATENT DOCUMENTS 2,198,873 A * 4/1940 Hinsdale ..... 72/353.6
2,954,002 A * 9/1960 Lyon ..... 72/353.6
4,270,497 A 6/1981 Valerio ..... 123/195 C
4,522,165 A 6/1985 Ogawa ..... 123/195 C
4,535,996 A 8/1985 Cardis et al. ..... 277/1
5,103,782 A 4/1992 Matsui ..... 123/195 C
5,406,823 A 4/1995 Yong et al. ..... 72/334
5,536,023 A 7/1996 Surbrook et al. ..... 277/235 B
5,662,337 A 9/1997 Surbrook et al. ..... 277/235 B
6,273,049 B1 8/2001 Okuda et al.

FOREIGN PATENT DOCUMENTS

JP 63-126622 * 5/1988 ..... 72/353.6

* cited by examiner

*Primary Examiner*—Lowell A. Larson
(74) *Attorney, Agent, or Firm*—Crompton, Seager & Tufte, LLC

(57) ABSTRACT

An oil pan includes an oil reservoir and a pair of side walls facing the reservoir. A bulge is formed in each side wall. Each bulge defines an oil sub chamber connected to the oil reservoir. The bulges are formed integrally with the side walls by deforming the side walls outward. In other words, the bulges are not fastened to the side wall but are part of it. The oil pan is therefore easily and inexpensively formed by pressing. Further, since there is no joint between each bulge and the side wall, the oil pan has improved strength and durability.

12 Claims, 13 Drawing Sheets

ENGINE OIL PAN AND FORMING METHOD AND APPARATUS

This application is a divisional of application Ser. No. 09/393,901, filed Sep. 10, 1999, now U.S. Pat. No. 6,273,049.

BACKGROUND OF THE INVENTION

The present invention relates to an oil pan of an engine mounted on a vehicle. More particularly, the present invention pertains to an oil pan that has a sub-oil chamber to increases the volume of an oil reservoir and to an apparatus for forming such oil pans.

A typical vehicle engine includes an oil pan fixed to the lower part of the cylinder block. The oil pan has a reservoir for storing oil, which is supplied to the moving parts of the engine. The reservoir must be large enough to store the oil required by the moving parts of the engine. However, the size and shape of the space allocated for the engine in the engine compartment limits the vertical dimension of the oil pan, which may restrict the volume of the oil pan. If the oil pan is formed by deep-drawing sheet metal, the vertical dimension of the oil pan is limited by the deep-drawing process. Therefore, even if an adequate space exits in the engine compartment, the oil pan cannot be made deep enough. As a result, the volume of the reservoir is not sufficient.

Insufficient reservoir volume causes the oil to deteriorate in a relatively short time. Therefore, the moving parts of the engine are not sufficiently lubricated. Insufficient lubrication wears the moving parts, which increases engine vibration and noise and lowers the fuel economy. The oil, therefore, must be frequently changed.

If the volume of the reservoir is too small yet the reservoir stores a sufficient amount of oil for the engine to function normally, the level of the oil becomes relatively high. The oil in the reservoir is vibrated by the engine, which causes the oil to interfere with moving members such as the connecting rods and the crankshaft. This increases rotational resistance, creates bubbles in the oil, increases the oil temperature and degrades the oil.

To solve this above problem, oil pans having baffles have been introduced. A baffle is fixed to the inner wall of the reservoir and extends over the surface of the oil such that oil contacts the baffle when vibrated. The baffle needs to be fixed to the inner wall by welding, which complicates the manufacture of the oil pan. Further, the joint between the baffle and the oil pan may deteriorate or fail due to engine vibration and to the force of the vibrating oil.

FIG. 15 shows a prior art oil pan 100. The oil pan 100 has sub tanks 101 to increase its volume. The sub tanks 101 are separately formed and welded to the side walls 102 of the oil pan 100. A side chamber 101*a*, which is defined in each sub tank 101, is connected to the reservoir 100*a* of the oil pan 100. However, since the sub tanks 101 are formed separately from the oil pan 100 and the sub tanks 101 are welded to the oil pan 100, the manufacturing process is troublesome. Further, the joints between the sub tanks 101 and the oil pan 100 are easily damaged and deteriorate quickly.

SUMMARY OF THE INVENTION

Accordingly, it is an objective of the present invention to provide a durable oil pan that stores a relatively large amount of oil and is easy to manufacture.

Another objective of the present invention is to provide an apparatus that easily forms the above oil pan.

To achieve the foregoing and other objectives and in accordance with the purpose of the present invention, an oil pan having surrounding wall defining an oil reservoir and a horizontally projecting bulge formed in the surrounding wall is provided. The bulge is integrally formed with the surrounding wall by outward deformation. The bulge defines an oil sub chamber connected to the oil reservoir.

The bulge is formed integrally with the surrounding wall of the oil pan. Unlike the prior art oil pan, the bulge does not have to be welded to the surrounding wall but is easily and inexpensively formed by pressing. Further, there is no joint between the surrounding wall and the bulge, which improves the strength and durability. The bulge also improves the rigidity of the surrounding wall.

The bulge preferably has an upper wall, which faces the surface of the oil. The upper wall is located above the surface of the oil in the reservoir.

When the engine is running, the surface of the oil in the reservoir is vibrated. However, the vibration is received by the upper wall of the bulge, which suppresses the vibration. This structure eliminates the necessity for a baffle attached to the inner wall of the oil pan for suppressing oil vibration. Therefore, problems caused by baffle plate, specifically, a complicated manufacturing process and deterioration of the joint, are avoided.

The present invention includes an apparatus for forming the above described oil pan. The apparatus includes a base, a first stage, a fixed hollow die, a tool, an outer die, a second stage, a first cam mechanism and a second cam mechanism. The first stage is moved closer to and away from the base. The fixed hollow die is located on the first stage. The outer shape of the fixed die corresponds to the inner shape of the oil reservoir. The fixed die includes an opening, the shape of which corresponds to the bulge. The tool is located in the interior of the fixed die to be movable in a direction substantially perpendicular to the moving direction of the first stage. The tool includes a projecting die, which can protrude from the opening of the fixed die. The outer shape of the projecting die corresponds to the inner shape of the bulge. The outer die is located on the first stage and is being movable in a direction substantially perpendicular to the moving direction of the first stage. The outer die moves toward and away from the fixed die. The outer die includes a recess, the inner shape of which corresponds to the outer shape of the bulge. The second stage faces the first stage with the outer die in between and is movable in the same direction as the first stage. The first cam mechanism is located between the base and the tool. When the first stage is moved toward the base, the first cam mechanism moves the tool such that the projecting die protrudes from the opening of the fixed die. The second cam mechanism is located between the second stage and the outer die. When the second stage is moved toward the first stage, the second cam mechanism moves the outer die toward the fixed die.

This apparatus facilitates the manufacture of oil pans having an integrated bulge. Particularly, the first and second cam mechanism causes the bulge to be formed simply by moving the first and second stage in one direction.

The present invention also includes a method of forming an oil pan. The method includes: placing a partially formed oil pan on a forming apparatus, the partially formed oil pan including a reservoir surrounded by a wall and an opening, wherein the opening defines a horizontal plane; and forming a bulge in the wall such that the bulge extends outward from the wall in a direction generally parallel to the horizontal plane, wherein the bulge increases the capacity of the reservoir.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

Figure 1:
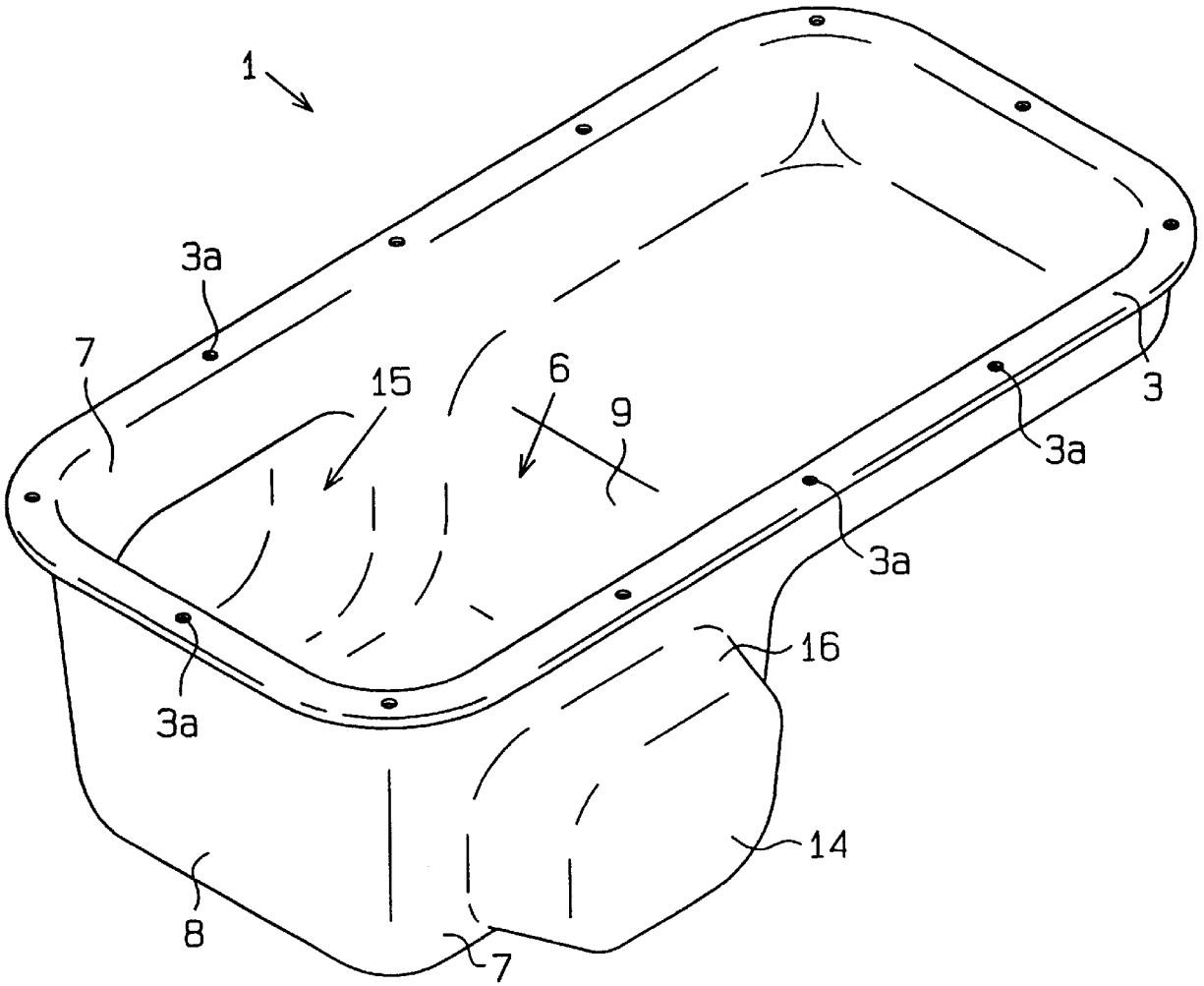
FIG. 1 is a perspective view illustrating an oil pan according to one embodiment of the present invention.
Figure 2:
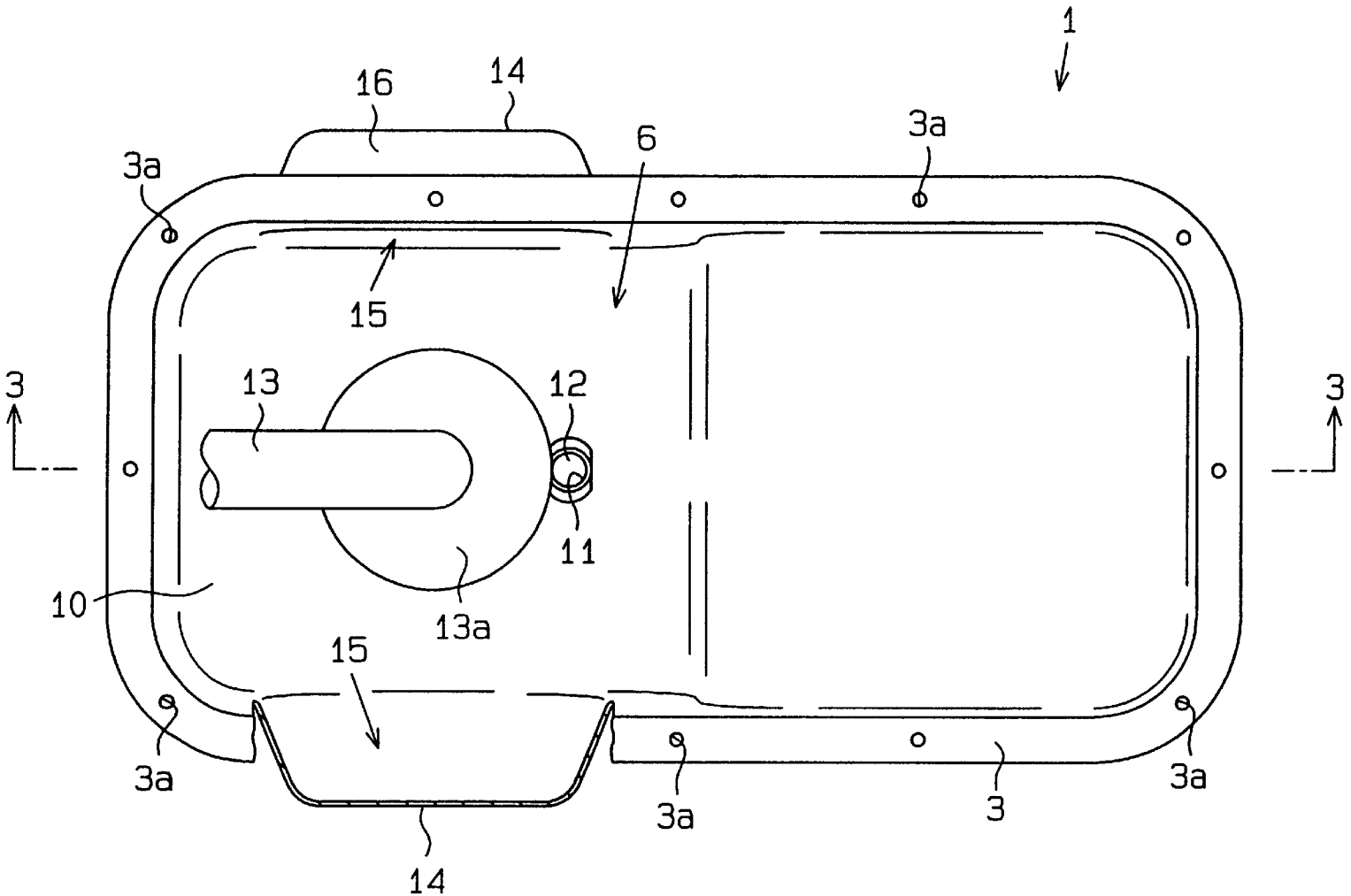
FIG. 2 is a plan view showing the oil pan of FIG. 1.

An oil pan 1 according to one embodiment of the present invention will now be described with reference to FIGS. 1 to 4.

As shown in FIGS. 1 to 4, the oil pan 1 has a flange 3, which is fastened to a cylinder block 2 of an engine. Bolt holes 3*a* are formed in the flange 3. A flange 4 is formed at the lower opening of the cylinder block 2. The flange 4 has threaded holes 4*a,* each of which corresponds to one of the bolt holes 3*a*. The flanges 3 and 4 are mated and bolts 5 are inserted into the bolt holes 3*a*. The bolts 5 are then threaded to the threaded holes 4*a,* which secures the oil pan 1 to the cylinder block 2.

The oil pan is integrally formed by pressing, for example, a single metal plate. The oil pan 1 has a substantially rectangular shape. A reservoir 6 is defined n the front half of the oil pan 1. The reservoir 6 has left and right side walls 7, a front wall 8, a rear wall 9 and a bottom wall 10. The side walls 7, the front wall 8 and the rear wall 9 form a surrounding wall to surround the reservoir 6.

A drain hole 11 is formed in the bottom wall 10 to drain oil from the reservoir 6. An oil drain plug 12 is threaded to the drain hole 11 to close the drain hole 11. A pickup tube 13 extends from inside the cylinder block 2 to the reservoir 6. A pickup screen 13*a* is attached to the distal end of the pickup tube 13. The pickup screen 13*a* is spaced from the bottom wall 10 by a predetermined distance.

A bulge 14 is formed on each side wall 7. Each bulge 14 is integrally formed with the corresponding side wall 7 and protrudes substantially horizontally from the side wall 7. Each bulge 14 defines a side chamber 15, which serves as a sub oil chamber connected to the reservoir 6. In other words, the side chambers 15 form a part of the reservoir 6. The volume of the reservoir 6 is increased by the volume of the side chambers 15, which permits to the reservoir 6 to store more oil.

Figure 3:
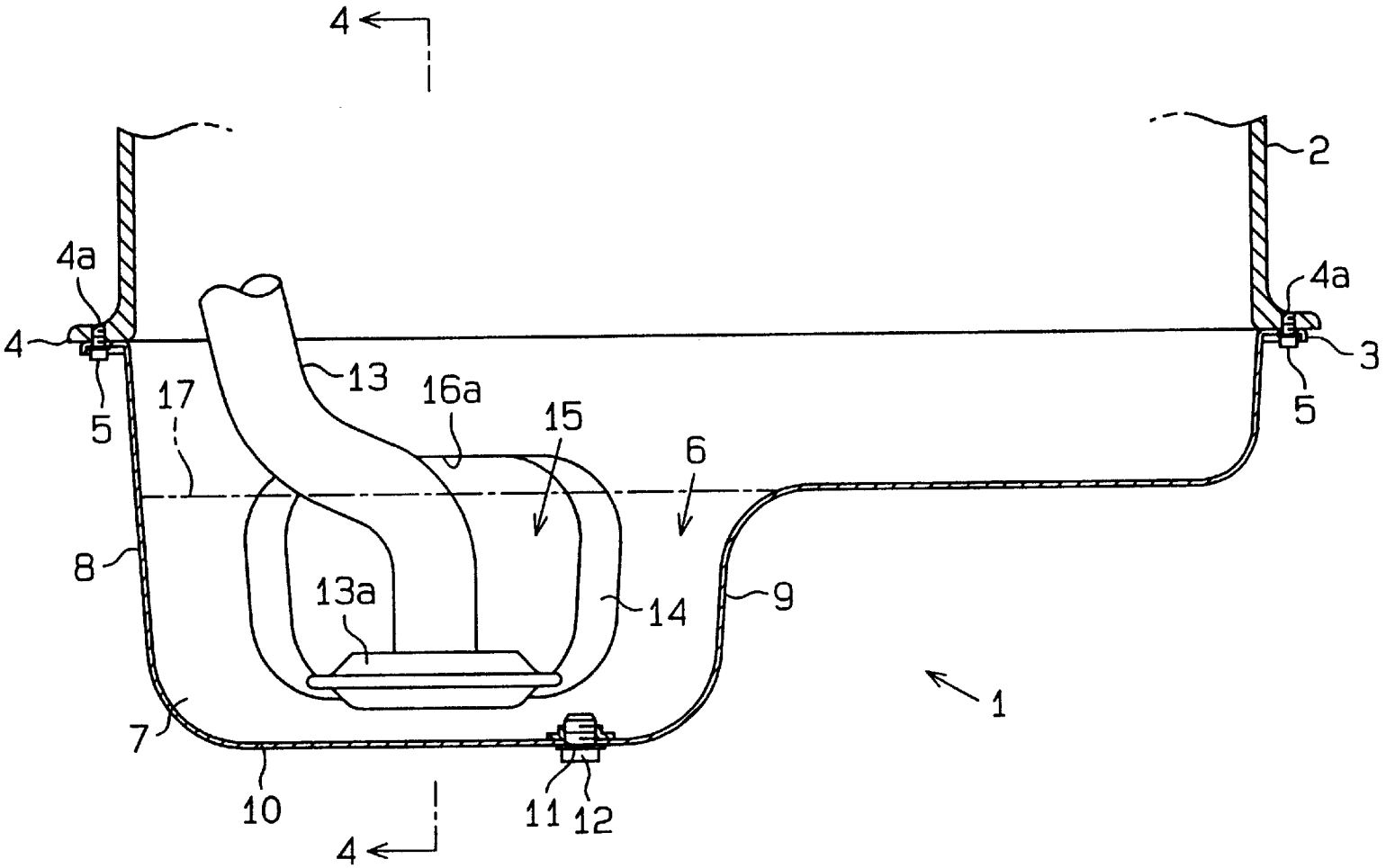
FIG. 3 is a cross-sectional view taken along line 3—3 of FIG. 2.
Figure 4:
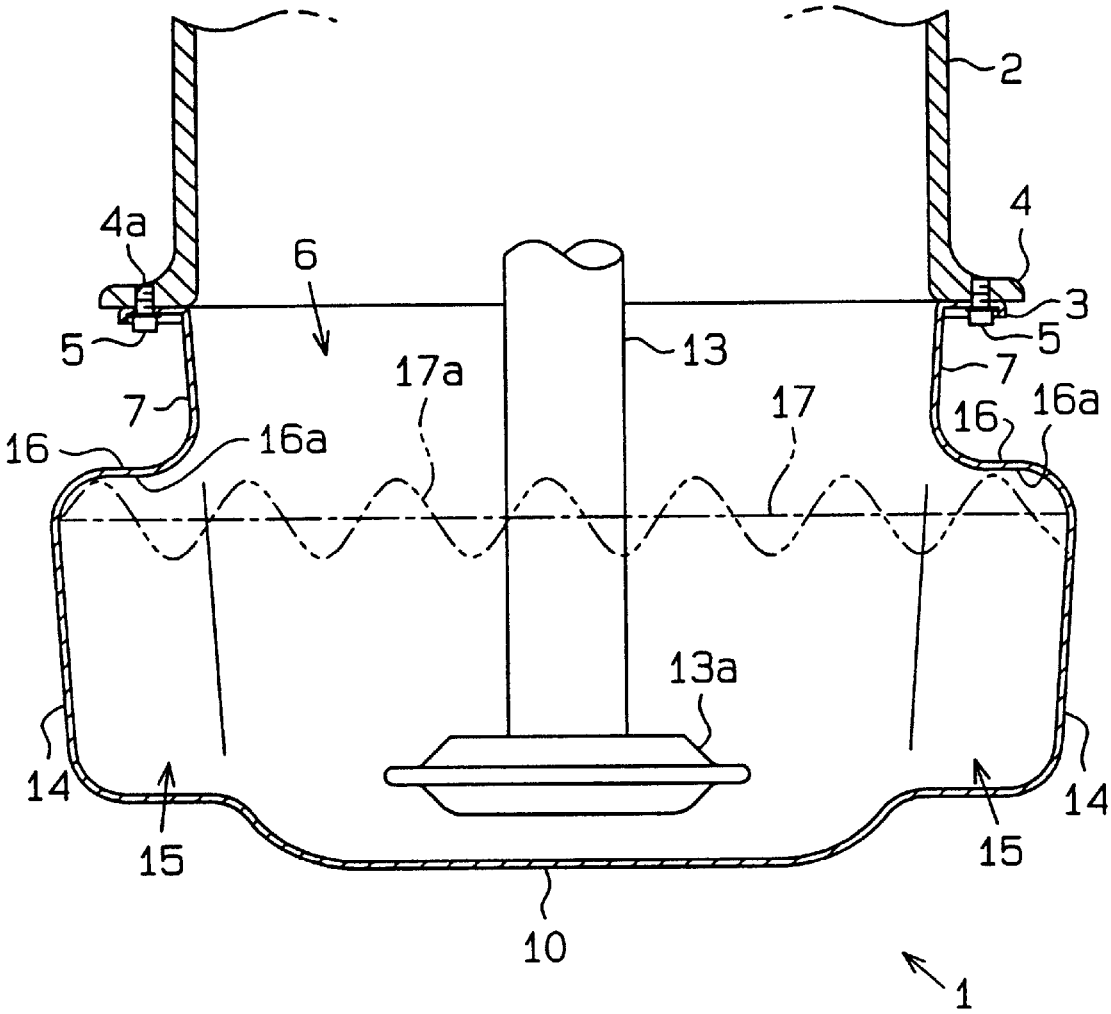
FIG. 4 is a cross-sectional view taken along line 4—4 of FIG. 3.

Each bulge 14 has a substantially horizontal upper wall 16. The upper wall 16 is formed such that the top wall surface 16*a* of each side chamber 15 is located above an oil surface 17, or standard oil level, in the reservoir 6. The surface 17 of the oil shown in FIGS. 3 and 4 represents the standard amount of oil needed for operation of the engine.

Operation and advantages of the oil pan 1 will now be described.

Figure 15:
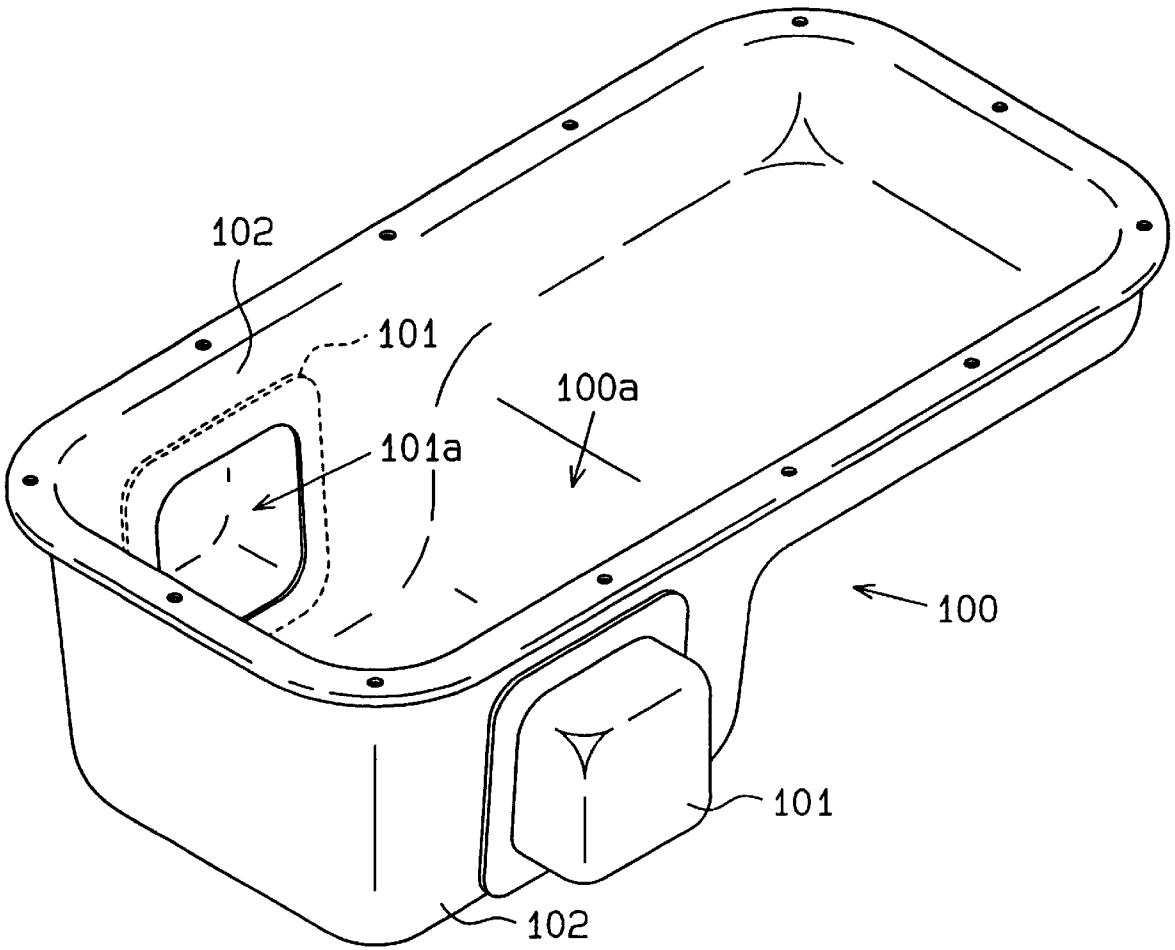
Fig.15(Prior Art)
FIG. 15 is a perspective view showing a prior art oil pan.

The bulges 14, which define the side chambers 15, are integrally formed with the side walls 7 of the oil pan 1. Therefore, unlike the oil pan 100 of FIG. 15, the bulges 14 are not welded to the side walls 7. The oil pan 1 is therefore easily formed by pressing, and the cost of producing the oil pan 1 is reduced compared to the prior art. Further, since there is no joint between each bulge 14 and the corresponding side wall 7, the strength and the durability of the oil pan 1 are improved.

The shape of each side wall 7 is not flat due to the bulges 14. The bulges 14 reinforce the oil pan 1. Further, the bulges 14, which are integrally formed with the side walls 7, reinforce the side walls 7 more effectively than bulges that are separately formed.

When the engine is running, the oil surface 17 becomes wavy as illustrated by line 17*a* of FIG. 4. However, the waves of the oil surface 17 are received by the top wall 16 of each bulge 14, which suppresses excessive waves. That is, the top walls 16 function like a baffle, which was provided in prior art oil pans as mentioned previously. Accordingly, the oil is prevented from interfering with moving members such as the connection rods and the crankshaft. The problems that would be caused by such interference, namely, increased bubbles, heating and oil deterioration are avoided. Further, the structure of the oil pan 1 prevents air from being drawn into the pickup screen 13*a* of the pickup tube 13, which allows the pickup tube 13 to constantly conduct oil. Accordingly, a steady flow of oil is supplied to the moving parts of the engine allowing the engine to run smoothly.

The oil pan 1 requires no baffle for suppressing waves on the oil surface 17. Thus, the problems caused by a baffle plate are avoided. Specifically, a complicated process for attaching the baffle to the side wall and deterioration of the joint between the baffle and the oil pan are avoided. The structure of the oil pan 1 reduces the cost of the oil pan and the weight of the oil pan 1.

Figure 5:
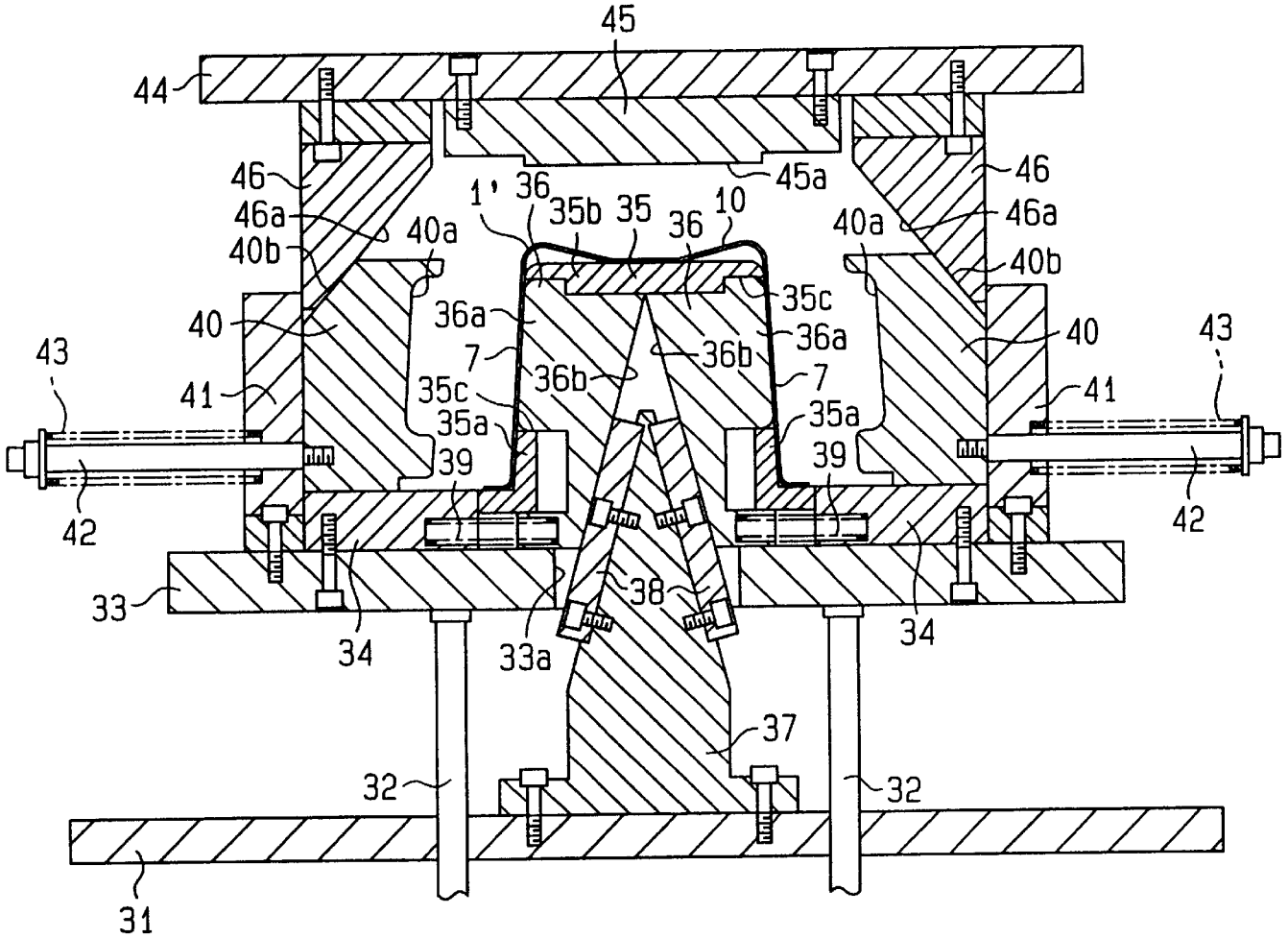
FIG. 5 is a cross-sectional view showing an apparatus for forming the oil pan of FIG. 1.

An apparatus for forming the bulges 14 of the oil pan 1 will now be described with reference to FIGS. 5 to 7. As shown in FIG. 5, a base 31 supports a first stage, or lower stage 33, by means of guide rods 32. The lower stage 33 can be moved vertically. Left and right support blocks 34 are fixed to the lower stage 33. A fixed hollow die 35 is located between the support blocks 34. The outer shape of the fixed die 35 corresponds to the inner shape of the reservoir 6. The fixed die 35 includes side wall supports 35*a* corresponding to the side walls 7 and a bottom support 35*b* corresponding to the bottom wall 10. Each side wall support 35*a* has an opening 35*c* the shape of which corresponds to the bulge 14. An unprocessed oil pan 1', on which the bulges 14 are not yet formed, is placed on the fixed die 35. Specifically, the reservoir 6 is fitted to the fixed die 35.

A pair of slide tools 36 are located in the interior of the fixed die 35. The tools 36 are movable in the horizontal direction (to left and right as viewed in FIG. 5) such that the tools 36 approach and move away from each other. Each slide tool 36 has a projecting die 36*a* the shape of which corresponds to the inner shape of one of the bulges 14. When the tools 36 are at the withdrawn position as shown in FIG. 5, the projecting dies 36*a* are located within the interior of the fixed die 35 and do not protrude from the openings 35*c*. When the tools 36 are extended from each other as shown in FIG. 7, the projecting dies 36*a* protrude from the openings 35*c*.

A cam support 37 is located on the base 31. The upper end of the cam support 37 enters the interior of the fixed die 35 through an opening 33*a* formed in the lower stage 33. Lower cams 38 are fixed to opposite sides of the cam support 37, which face the tools 36. Each slide tool 36 has an inclined surface 36*b* that contacts the corresponding lower cam 38. The lower cams 38 and the inclined surfaces 36*b* form first cam mechanism.

An urging member, or spring (for example, a coil spring) 39, is located between each slide tool 36 and the corresponding support block 34. Each spring 39 urges the corresponding slide tool 36 toward the corresponding lower cam 38 such that each inclined surface 36*b* constantly contacts the corresponding lower cam 38. As the lower stage 33 is lowered toward the base 31, cooperation between the lower cams 38 and the inclined surfaces 36*b* moves the tools 36 away from each other against the force of the springs 39.

A pair of outer dies 40 are located on the support block 34. Each outer die 40 is movable in the horizontal direction (left and right as viewed in FIG. 5) to approach and move away from the fixed die 35. Each outer die 40 has a recess 40*a*, the shape of which corresponds to the outer shape of the bulge 14. A pair of support plates 41 are fixed to the lower stage 33 to correspond to the outer dies 40. A guide rod 42 is coupled to each outer die 40 and extends through the support plate 41. An urging member, or spring (for example, a coil spring) 43 is located between the distal end of each guide rod 42 and the corresponding support plate 41. Each spring 43 urges the corresponding outer die 40 away from the fixed die 35.

A second stage, or upper stage 44, is located above the lower stage 33. The upper stage 44 is vertically movable. A pressing block 45 is secured to the lower side of the upper stage 44. The pressing block 45 has a pressing surface 45*a* facing the bottom support 35*b* of the fixed die 35. A pair of upper cams 46 are also secured to the lower side of the upper stage 44. Each upper cam 46 has an inclined cam surface 46*a*. Each outer die 40 has an inclined surface 40*b* facing the corresponding inclined cam surface 46*a*. The inclined cam surfaces 46*a* and the inclined surfaces 40*b* form second cam mechanism. Each spring 43 urges the corresponding outer die 40 such that the inclined surfaces 40*b* constantly contact the corresponding inclined cam surfaces 46*a*.

When the upper stage 44 is lowered toward the lower stage 33, cooperation of the inclined cam surfaces 46*a* and the inclined surfaces 40*b* moves the outer dies 40 toward the fixed die 35 against the force of the springs 43.

Operation of the apparatus of FIGS. 5 to 7 will now be described. FIG. 5 shows an initial state of the apparatus. In this state, the upper stage 44 and the lower stage 33 are at their highest positions. The pressing block 45 and the outer dies 40 are as far as possible from the fixed die 35, and the tools 36 are at the withdrawn position and do not protrude from the openings 35*c* of the fixed die 35. In this state, the unprocessed oil pan 1', which has no bulges 14, is set on the fixed die 35 through a space between the pressing block 45, the outer dies 40 and the fixed die 35 when the pressing block is lifted and separated from the outer dies 40 (not shown). That is, the upper stage 44 and the pressing block 45 are removed to permit access to the interior of the apparatus. Since the bulges 14 will be formed on the side walls 7, the bottom wall 10 has extra material, which does not contact the bottom support 35*b*, as shown in FIG. 5.

Then, the upper stage 44 is lowered by a pressing mechanism (not shown) such as a press. The upper stage 44 is lowered together with the pressing block 45 and the upper cams 46 toward the lower stage 33. As the upper stage 44 is lowered, cooperation of the inclined cam surfaces 46*a* and the inclined surfaces 40*b* moves the outer dies 40 toward the fixed die 35 against the force of the springs 43. When the pressing block 45 and the outer dies 40 contact the oil pan 1' placed on the fixed die 35 as shown in FIG. 6, the movement of the upper stage 44 relative to the lower stage 33 is stopped.

The pressing mechanism continues to pressing the upper stage 44 downward, which causes the upper stage 44 and the lower stage 33 to integrally move toward the base 31. As the lower stage 33 is lowered, cooperation of the lower cams 38 and the inclined surfaces 36*b* moves the tools 36 away from each other against the force of the springs 39. Accordingly, the projecting die 36*a* of each tool 36 gradually protrudes from the corresponding opening 35*c* of the fixed die 35. The projecting dies 36*a* deform the side walls 7 of the oil pan 1' outward thereby forming the bulges 14 as shown in FIG. 7. When the distal end of the cam support 37 contacts the inner surface of the bottom support 35*b* and each projecting die 36*a* is pressed against the recess 40*a* of the corresponding outer die 40 with the side walls 7 in between, as shown in FIG. 7, the lowering movement of the upper and lower stages 44, 33 is stopped. As a result, the bulges 14, which integrally protrude from the side walls 7, are formed between the projecting dies 36*a* and the recesses 40*a* of the outer dies 40.

To remove the processed oil pan 1, which has the bulges 14, from the apparatus, the pressing force of the pressing mechanism applied to the upper stage 44 is removed. Then, the force of the springs 39, 43 returns the apparatus back to the initial state shown in FIG. 5 in a reversal of the above steps. Thus, the processed oil pan 1 is easily removed from the apparatus, and another unprocessed oil pan 1' is easily set in the apparatus.

As described above, the apparatus of FIGS. 5 to 7 easily forms the oil pan 1 having integrally formed bulges 14. Particularly, the apparatus of FIGS. 5 to 7 includes the inclined cams 38, 46. Thus, the forming steps are consecutively performed by simply moving the upper stage 44 downward. Further, after the oil pan 1 is formed, the apparatus is returned to the initial state by the force of the springs 39, 43. Therefore, compared to an apparatus that has vertically moving members and horizontally moving members that are each actuated by different actuators, the apparatus of FIGS. 5 to 7 has a simpler structure. The apparatus moves all parts with an accurate timing, which guarantees an accurate forming process.

Figure 6:
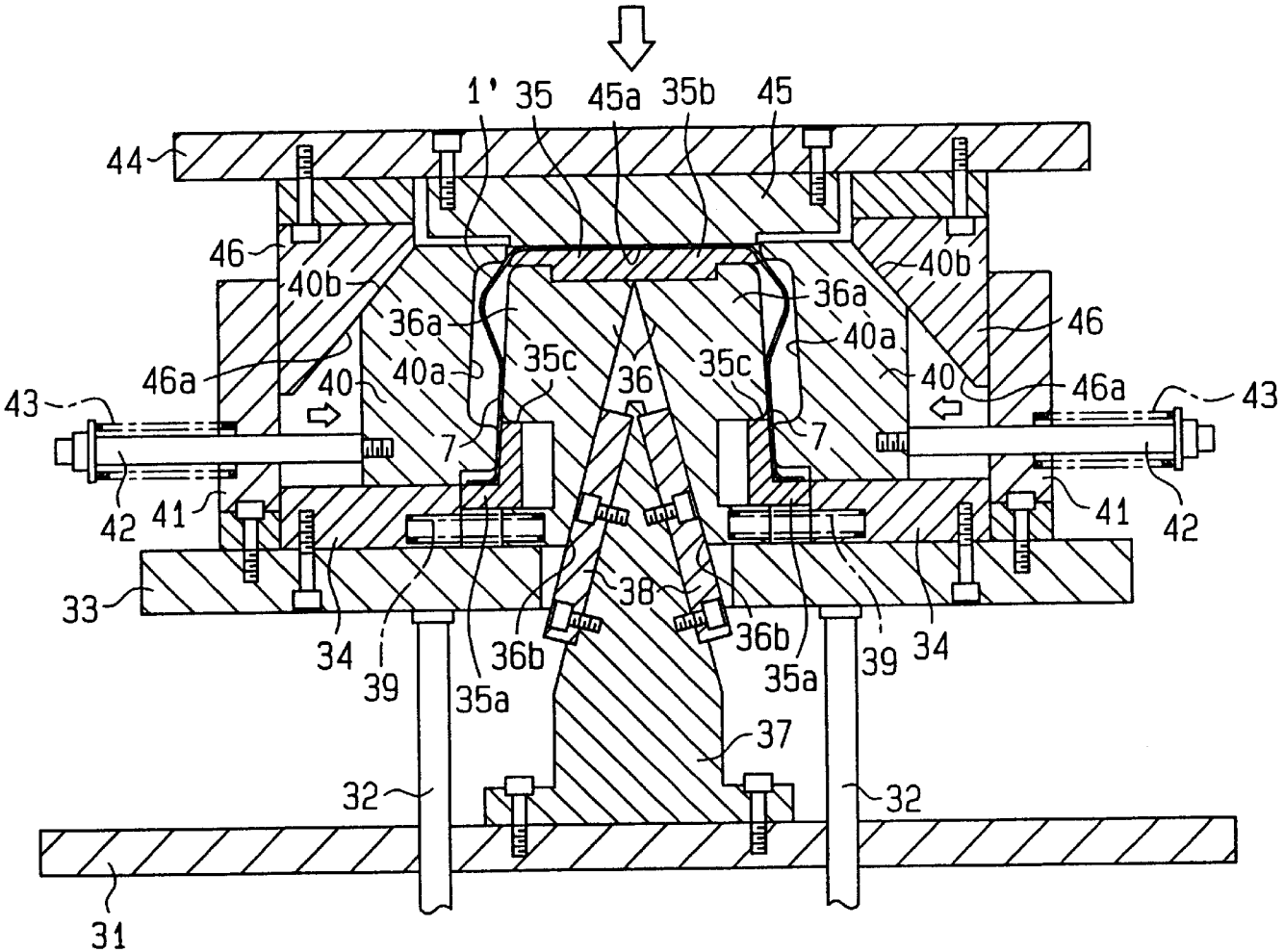
FIG. 6 is a cross-sectional view like FIG. 5 showing operation of the apparatus of FIG. 5.
Figure 7:
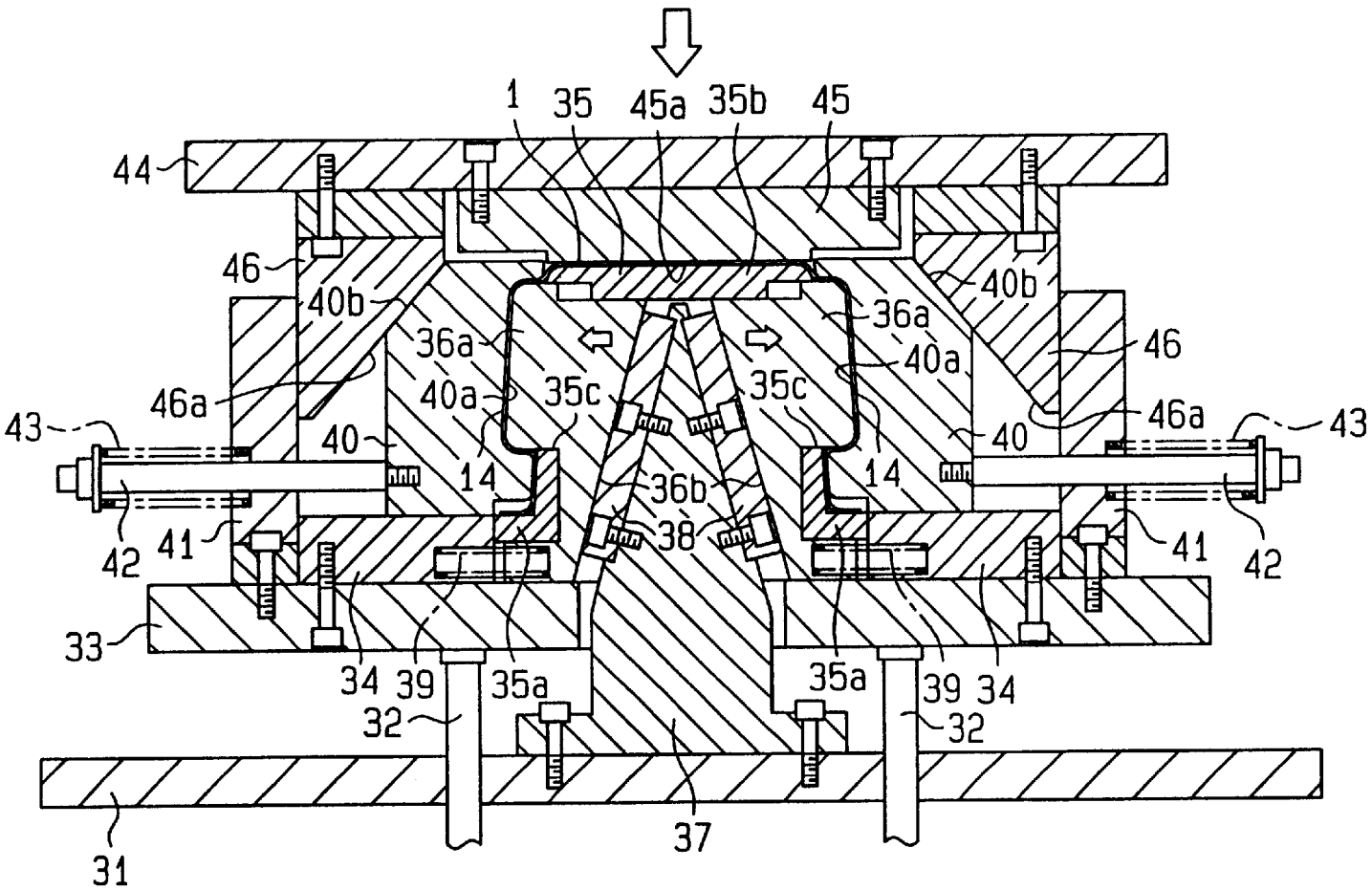
FIG. 7 is a cross-sectional view like FIG. 5 showing operation of the apparatus of FIG. 5.

Further, the apparatus of FIGS. 5 to 7 automatically returns to the initial state by simply releasing the pressing force of the pressing mechanism. Therefore, no power is required to restore the apparatus to its initial state. When the apparatus is opened, the processed oil pan 1 is easily removed from the apparatus and an unprocessed oil pan 1' is easily set in the apparatus. This apparatus is therefore suitable for mass producing the oil pans 1.

The result of an experiment for measuring the noise characteristics of the oil pan 1 shown in FIGS. 1 to 4 will now be described with reference to FIGS. 8 to 11. The experiment was performed for evaluating noise from oil pans when the engine is running. In this experiment, a bulge model 50 of FIG. 8 and a flat model 55 of FIG. 9 were used.

Figure 8:
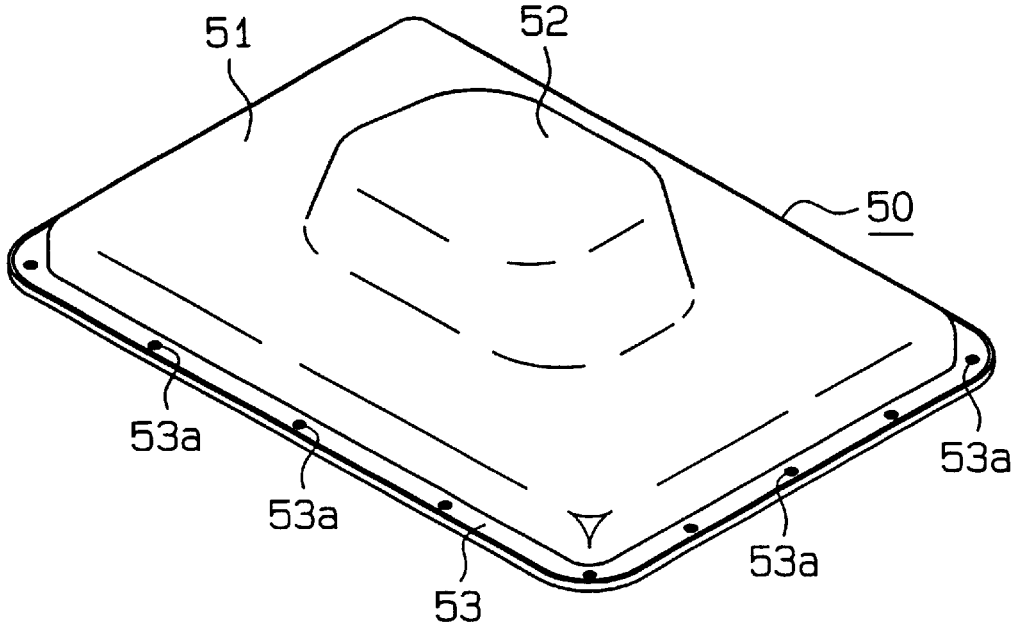
FIG. 8 is a perspective view illustrating a bulge model.
Figure 9:
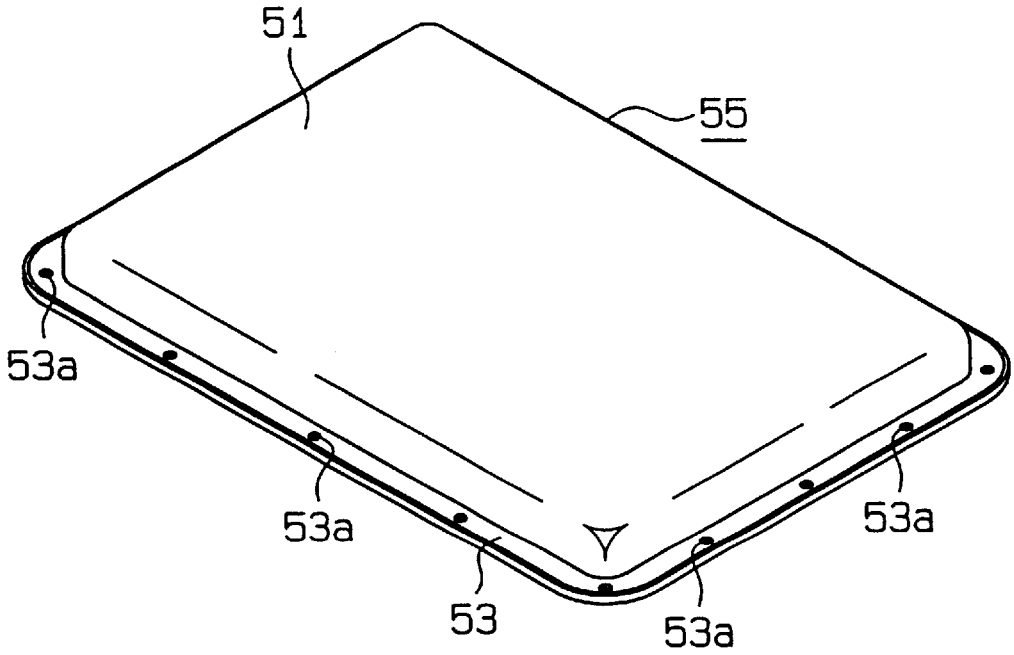
FIG. 9 is a perspective view illustrating a flat model.

The bulge model 50 of FIG. 8 was formed to resemble the side wall 7 having the integrally formed bulge 14. That is, the bulge model 50 had a plate 51, which corresponded to the side wall 7 of the oil pan 1 shown in FIGS. 1 to 4, and a bulge 52, which corresponded to the bulge 14 of the oil pan 1 of FIGS. 1 to 4. A flange 53 was formed in the peripheral portion of the plate 51. Bolt holes 53*a* were formed in the flange 53. The flat model 55 of FIG. 9 was the same except that it had no bulge 52. That is, the flat model 55 was formed to resemble the side wall 7 without a bulge 14.

Figure 10:
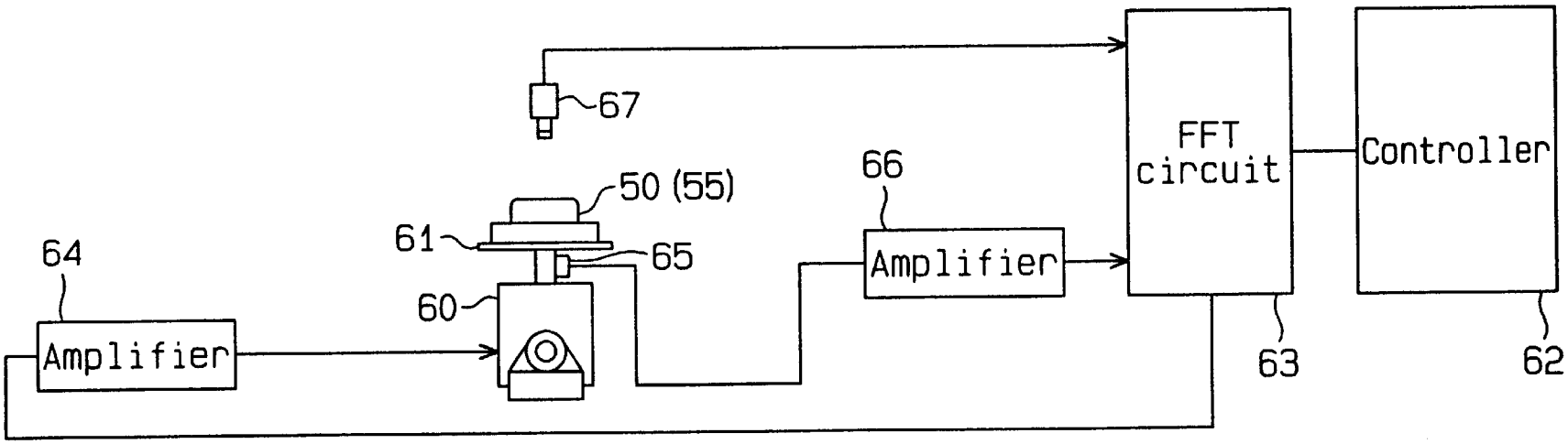
FIG. 10 is a block diagram showing a vibration experiment apparatus.

FIG. 10 shows an experiment apparatus. The experiment apparatus has a vibrator 60 for vibrating the bulge model 50 and the flat model 55. The bulge model 50 and the flat model 55 were separately placed on a vibration plate 61 of the vibrator 60. The models 50, 55 were each attached to the vibration plate 61 with fasteners (not shown) such as bolts, which were inserted in the bolt holes 53*a*.

A controller 62 included a central processing unit (CUP). A fast Fourier transform circuit (FFT circuit) 63 was connected to the controller 62. The FFT circuit 63 generates a predetermined frequency signal, which is supplied to the vibrator 60 via an amplifier 64. The vibrator 60 separately vibrated each model 50, 55 on the vibration plate 61 in accordance with the frequency signal. The vibrator 60 has a sensor 65 for detecting the frequency of vibration. The sensor 65 sends detection signal to the controller 62 via the amplifier 66 and the FFT circuit 63. The controller 62 feedback controls the FFT circuit 63 based on the detection signal from the sensor 65 thereby causing the vibrator 60 to generate vibration of a desired frequency.

A noise meter 67 was located above the model 50, 55 on the vibration plate 61. The noise meter 67 detected the noise from the model 50, 55 being tested and sent a detection signal to the FFT circuit 63. The controller 62 executed frequency analysis of the detection signal from the noise meter 67 by means of the FFT circuit 63.

Figure 11:
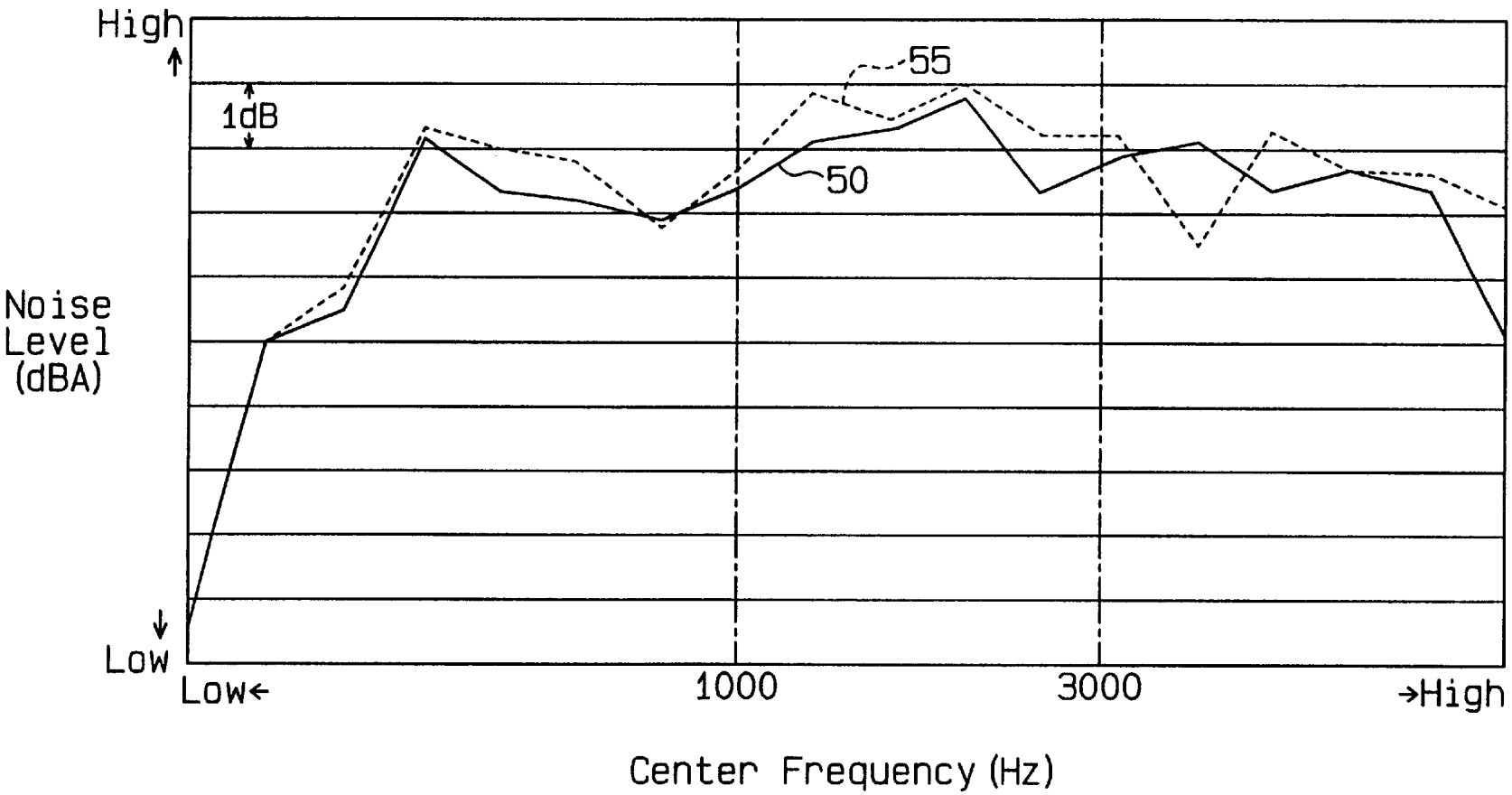
FIG. 11 is a graph showing the noise characteristics of the bulge model of FIG. 8 and the flat model of FIG. 9.

FIG. 11 shows a result of the frequency analysis performed on noise generated by the bulge model 50 and the flat model 55 using the experiment apparatus of FIG. 10. As shown in the graph of FIG. 11, the bulge model 50 was generally quieter than the flat model 55 by 0.9 dB. Particularly, when the mean frequency in noise was in a range between 1000 Hz and 3000 Hz, which is most annoying to humans, the noise level was significantly decreased.

As obvious from the result of the experiment, the bulges 14, which are integrally formed with the oil pan 1, effectively decrease noise generated by the oil pan 1 when the engine is running. One of the reasons for this effect is that the bulges 14 increase the rigidity of the oil pan 1.

Other embodiments of the oil pan 1 according to the present invention will now be described.

Figure 12:
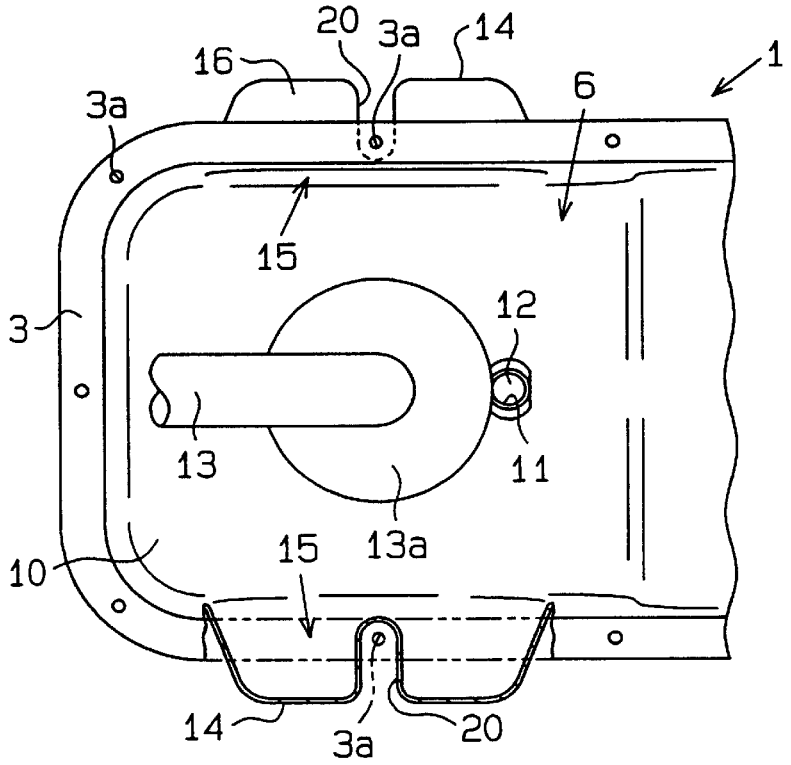
FIG. 12 is a partial plan view showing an oil pan according to another embodiment of the present invention.

FIG. 12 shows an oil pan 1 according to another embodiment. In this embodiment, recesses 20 are formed in the bulges 14. The recesses 20 permit two of the bolts 5 inserted in the bolt holes 3*a* to extend through the bulges 14. Each recess 20 extends vertically along the axis of the corresponding bolt hole 3*a*. This structure allows bolts 5 to be inserted into the corresponding bolt hole 3*a* from below the oil pan 1 through the recess 20. Also, a worker can easily manipulate a tool for threading the bolt 5 through the recess 20. Accordingly, the oil pan 1 is easily fixed to the cylinder block 2. The recesses 20 further improve the rigidity of the side walls 7.

Figure 13:
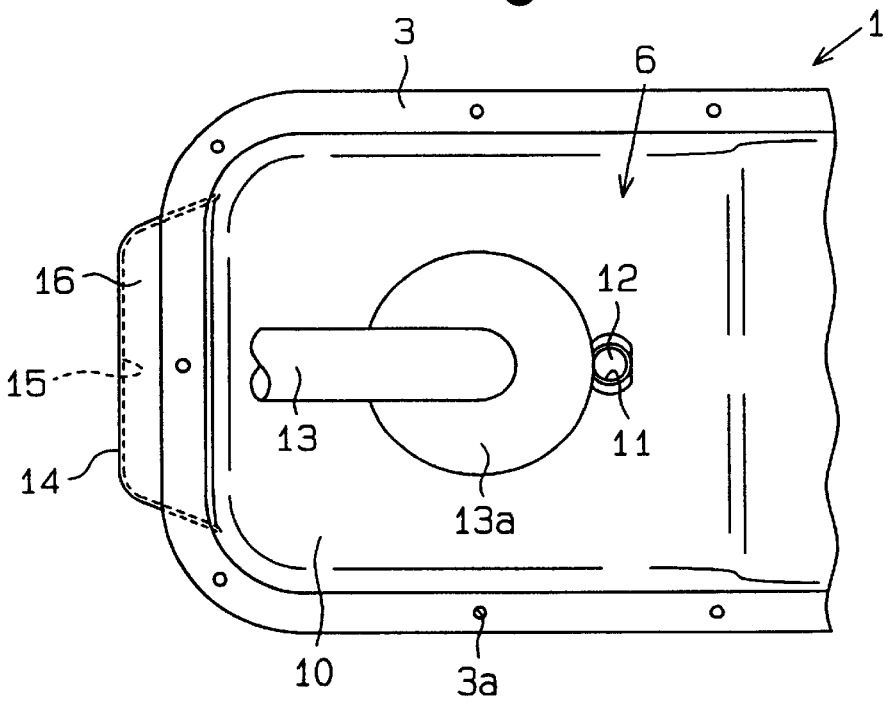
FIG. 13 is a partial plan view showing an oil pan according to a further embodiment of the present invention.

FIG. 13 shows an oil pan 1 according to another embodiment. The oil pan 1 of FIG. 14 has a bulge 14 that is integrally formed with the front wall 8 instead with the side wall 7. Therefore, a bulge may be formed in parts other than the side walls 7. Particularly, when one of the bulges would interfere with other structures in the engine compartment if formed in one of the side walls 7, forming a bulge 14 in the front wall 8 is effective. Alternatively, one of the bulges 14 of the side walls 7 may be omitted and a bulge 14 may be formed in the front wall 8.

Figure 14:
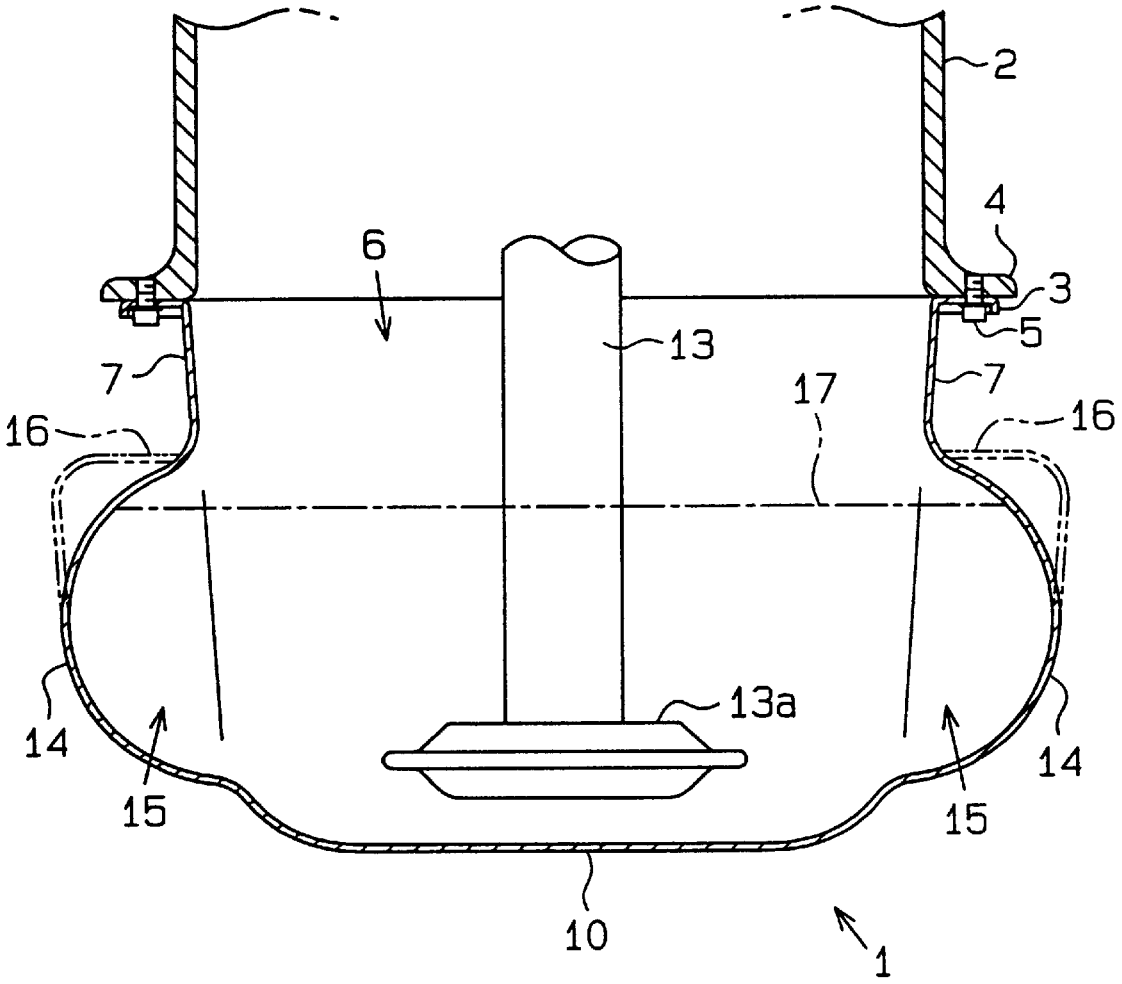
FIG. 14 is a partial cross-sectional view showing an oil pan according to yet another embodiment of the present invention.

FIG. 14 shows an oil pan 1 according to another embodiment. The bulges 14 of the oil pan 1 of FIG. 14 are substantially semispherical. This shape further improves the rigidity of the oil pan 1. As illustrated by a two-dot chain line in FIG. 14, the upper portion of the bulges 14 may be changed such that horizontal upper walls 16, as in the embodiment of FIGS. 1 to 4, are formed. The upper walls 16 suppress the vibration of oil.

It should be apparent to those skilled in the art that the present invention may be embodied in many other specific forms without departing from the spirit or scope of the invention. Particularly, it should be understood that the invention may be embodied in the following forms.

In the oil pan 1 of FIGS. 1 to 4, one of the bulges 14 may be omitted from the side wall 7.

The location, shape and the size of the bulges 14 may be altered in accordance with the size and shape of the space allocated for the oil pan 1 in the engine compartment Therefore, the present examples and embodiments are to be considered as illustrative and not restrictive and the invention is not to be limited to the details given herein, but may be modified within the scope and equivalence of the appended claims.

What is claimed is:

1. An apparatus for forming an oil pan, wherein the oil pan includes a surrounding wall defining an oil reservoir and a horizontally projecting bulge formed in the surrounding wall, wherein the bulge is integrally formed with the surrounding wall by outward deformation, and wherein the bulge defines an oil sub chamber connected to the oil reservoir, the apparatus comprising:

a base;

a first stage, which is moved closer to and away from the base;

a fixed hollow die located on the first stage, wherein the outer shape of the fixed die corresponds to the inner shape of the oil reservoir, and wherein the fixed die includes an opening, the shape of which corresponds to the bulge;

a tool located in the interior of the fixed die to be movable in a direction substantially perpendicular to the moving direction of the first stage, wherein the tool includes a projecting die, which can protrude from the opening of the fixed die, and the outer shape of the projecting die corresponds to the inner shape of the bulge;

an outer die located on the first stage, the outer die being movable in a direction substantially perpendicular to the moving direction of the first stage, wherein the outer die moves toward and away from the fixed die, wherein the outer die includes a recess, the inner shape of which corresponds to the outer shape of the bulge;

a second stage facing the first stage with the outer die in between, wherein the second stage is movable in the same direction as the first stage;

a first cam mechanism located between the base and the tool, wherein, when the first stage is moved toward the base, the first cam mechanism moves the tool such that the projecting die protrudes from the opening of the fixed die; and a second cam mechanism located between the second stage and the outer die, wherein, when the second stage is moved toward the first stage, the second cam mechanism moves the outer die toward the fixed die.

2. The forming apparatus according to claim 1, wherein the first cam mechanism includes a first cam supported by the base and a first follower surface connected to the tool to engage the first cam, the first cam having a first cam surface, which contacts the first follower surface, and wherein the first follower surface and the first cam surface are inclined relative to the moving direction of the first stage.

3. The forming apparatus according to claim 2, further comprising an urging member for urging the tool such that the first follower surface constantly contacts the first cam surface.

4. The forming apparatus according to claim 1, wherein the second cam mechanism includes a second cam supported by the second stage and a second follower surface connected to the outer die to engage the second cam, the second cam having a second can surface, which contacts the second follower surface, and wherein the second follower surface and the second cam surface are inclined relative to the moving direction of the second stage.

5. The forming apparatus according to claim 4, further comprising an urging member for urging the outer die such that the second follower surface constantly contacts the second cam surface.

6. The forming apparatus according to claim 1, further comprising an urging member for urging the projecting die into the interior of the fixed die.

7. The forming apparatus according to claim 1, further comprising an urging member for urging the outer die away from the fixed die.

8. A method of forming an oil pan comprising:

(a) placing a partially formed oil pan on a forming apparatus, the partially formed oil pan including a reservoir surrounded by a wall and an opening, wherein the opening defines a horizontal plane; and (b) forming a bulge in the wall such that the bulge extends outward from the wall in a direction generally parallel to the horizontal plane, wherein the bulge increases the capacity of the reservoir, wherein the bulge is formed by:

(i) moving an inner die, which is located inside the partially formed oil pan, outward in directions generally parallel to the horizontal plane, and (ii) moving an outer die, which is located outside the partially formed oil pan, inward toward the inner die in directions generally parallel to the horizontal plane.

9. The method according to claim 8, wherein an upper stage of the forming apparatus is removed from the forming apparatus prior to placing the partially formed oil pan on the forming apparatus, and the upper stage is replaced on the forming apparatus prior to forming the bulge.

10. The method according to claim 9, wherein the bulge is formed by applying a force to the upper stage in a direction perpendicular to the horizontal plane.

11. The method according to claim 8, wherein the bulge is formed by applying a force to the forming apparatus in a direction perpendicular to the horizontal plane.

12. The method according to claim 8, wherein both the inner die and the outer die are moved by applying a force to the forming apparatus in a direction perpendicular to the horizontal plane.

* * * * *